US007024971B2

(12) United States Patent
Stanton

(10) Patent No.: US 7,024,971 B2
(45) Date of Patent: Apr. 11, 2006

(54) OPEN END RATCHET WRENCH

(76) Inventor: John L. Stanton, 1550 Hazelwood Dr., Clarksville, TN (US) 37043

( * ) Notice: Subject to any disclaimer, the term of this patent is extended or adjusted under 35 U.S.C. 154(b) by 264 days.

(21) Appl. No.: 10/386,917

(22) Filed: Mar. 12, 2003

(65) Prior Publication Data

US 2004/0194589 A1 Oct. 7, 2004

(51) Int. Cl.
*B25B 13/12* (2006.01)

(52) U.S. Cl. ..... 81/179; 81/92

(58) Field of Classification Search ..... 81/179, 81/186, 92, 94, 111
See application file for complete search history.

(56) References Cited

U.S. PATENT DOCUMENTS

| | | | |
|---|---|---|---|
| 1,406,467 | A | 2/1922 | Matthey |
| 1,489,458 | A | 4/1924 | Petersen |
| 1,732,000 | A | 10/1929 | Colognori |
| 2,047,548 | A | 7/1936 | Colognori et al. |
| 2,426,191 | A | 4/1947 | Feiring |
| 2,712,259 | A | 7/1955 | Cowell |
| 2,795,160 | A | 6/1957 | Blasdell |
| 3,695,125 | A | 10/1972 | Glass et al. |
| 3,921,474 | A | 11/1975 | Dyck et al. |
| 3,927,582 | A | 12/1975 | Hertelendy et al. |
| 4,204,440 | A | 5/1980 | Del Prete et al. |
| 4,488,459 | A | 12/1984 | Bailey et al. |
| 4,574,665 | A | 3/1986 | Blachly |
| 4,644,830 | A | 2/1987 | Bailey et al. |
| 4,718,315 | A | 1/1988 | Nitschmann |
| 4,787,277 | A | 11/1988 | Myers |
| 4,848,193 | A | 7/1989 | Wylie, III |
| 4,926,720 | A | 5/1990 | Srzanna |
| 5,148,725 | A | 9/1992 | Botha |
| 5,427,004 | A | 6/1995 | Monaco |
| 5,456,143 | A | 10/1995 | Stanton |
| 5,533,428 | A | 7/1996 | Pradelski |
| 5,553,520 | A | 9/1996 | Jacobs |
| 5,582,082 | A | 12/1996 | Gajo |
| 5,829,327 | A | 11/1998 | Stanton |
| 6,223,630 | B1 | 5/2001 | Stanton |
| 6,412,372 | B1 * | 7/2002 | Hsu ..... 81/111 |

FOREIGN PATENT DOCUMENTS

| | | |
|---|---|---|
| FR | 568058 | 12/1923 |
| JP | 90211713 | 7/2001 |

OTHER PUBLICATIONS

*Griot's Garage*, "Ratchet Flare Nut Wrench," p. 7, Spring 1994.

* cited by examiner

*Primary Examiner*—Derris H. Banks
*Assistant Examiner*—J Williams
(74) *Attorney, Agent, or Firm*—Fish & Richardson P.C.

(57) ABSTRACT

A wrench has a pair of jaws that are disposed on a handle and spaced to define an opening for a workpiece. A first one of the jaws defines a stationary workpiece engaging surface adjacent the opening, and a plate defining a second workpiece engaging surface adjacent the opening is movably mounted to a second one of the jaws to allow selective movement of the plate relative to the stationary workpiece engaging surface between: a) a first state in which the plate is immobile with respect to the first jaw so that rotation of the handle in a first direction causes the plate and the first jaw to grasp the workpiece between the respective engaging surfaces and turn the workpiece in a first direction, and b) a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary. Thus, the wrench tightens (or loosens) the workpiece when rotated in the first direction, and slips over the workpiece in a "ratcheting" manner when rotated in the second, opposite direction.

26 Claims, 5 Drawing Sheets

OPEN END RATCHET WRENCH

BACKGROUND

This invention relates to ratchet wrenches, and more particularly to open end ratchet wrenches that can be placed on a workpiece from the side.

There are many occasions when it is desirable to apply torque to a workpiece (such as nuts, bolts, and in-line hydraulic fittings) in order to, for example, rotate the workpiece with respect to a threaded member. Two well-known tools for rotating workpieces are ratchet wrenches and open-end crescent wrenches. Ratchet wrenches are typically close-ended devices that completely encircle the workpiece and are thus installed on the workpiece from the top (or bottom, depending upon the orientation of the workpiece). By contrast, open-end wrenches can be installed from the side of the workpiece.

Open-end wrenches are particularly useful in small spaces where there may only be sufficient room to install the wrench from the side. Moreover, in confined spaces, there is often insufficient space to accommodate the ratchet mechanism of typical close-ended ratchet wrenches. In addition, open-end wrenches are a must for tightening/loosening in-line fittings of hydraulic or fuels lines, which can only receive a wrench from the side.

Typical open-end crescent wrenches lack a ratchet mechanism. As a result, during a tightening or loosening operation, the wrench must be removed from the workpiece after it has rotated a relatively small amount (such as 30 degrees), and then replaced thereon at a different angle for continued rotation. This procedure is repeated (often many times) until the workpiece is completely tightened or loosened.

Open-end ratchet wrenches that resemble typical crescent wrenches have been developed for confined and in-line fitting applications. Some open-end ratchet wrenches employ numerous spring-loaded rollers, cams, or pawls for engaging the workpiece; others use an insert shaped to fit over the workpiece and engage an internal ratchet mechanism. Some of these wrenches encircle the workpiece to such an extent that, even though the wrenches have open ends, they must actually be installed vertically from above or below the workpiece.

Other open-end ratchet wrenches described in my U.S. Pat. Nos. 5,456,143, 5,829,327 and 6,223,630 include a pair of elongated plates that are pivotally mounted to a pair of spaced jaws on the wrench handle. A spring mounted on the handle engages the plates and biases them toward each other so that the plates grasp and turn the workpiece when the handle is rotated in a driving direction. The spring bias is overcome when the handle is turned in the opposite direction, allowing both plates to pivot on the jaws and slide over the faces of the workpiece in a ratcheting manner.

SUMMARY

This invention features, in a general aspect, a wrench having a pair of jaws disposed on a handle and spaced to define an opening for a workpiece; a first one of the jaws defines a stationary workpiece engaging surface adjacent the opening, and a plate defining a second workpiece engaging surface adjacent the opening is movably mounted to a second one of the jaws to allow selective movement of the plate relative to the stationary workpiece engaging surface between: a) a first state in which the plate is immobile with respect to the first jaw so that rotation of the handle in a first direction causes the plate and the first jaw to grasp the workpiece between the respective engaging surfaces and turn the workpiece in a first direction, and b) a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary. Thus, the wrench tightens (or loosens) the workpiece when rotating in the first direction, and slips over the workpiece in a "ratcheting" manner when rotated in the second, opposite direction. The invention also includes a method of operating the wrench.

The invention unites features of an open-end wrench and a ratchet wrench in a wrench that is rugged and simple to make. The wrench has a minimal number of moving parts (e.g., the plate and, as discussed below, spring that biases the plate toward the opening) and this is much easier to manufacture (and repair) than wrenches which use many individual pawls or rollers to provide ratcheting. In preferred embodiments, the plate and first jaw each engage the workpiece over a relatively large surface area, thereby maximizing torque transmission and minimizing contact stresses imposed on the wrench and the workpiece. This reduces the risk of damage to the wrench and the workpiece.

The spacing between the jaws and the configuration of the plate permits them to operate the workpiece while engaging, e.g., four or five faces (240 degrees–300 degrees), yet still be easily inserted onto and removed from the workpiece from the side for use in cramped spaces. In preferred embodiments, the ratcheting operation is assisted by a spring which biases the plate toward the opening, which makes turning the workpiece fast and easy while requiring no clearance behind the workpiece.

Preferred embodiments may include one or more of the following additional features. The plate is mounted for the selective movement between the first and second states in response to rotation of the handle. No separate locking or unlocking mechanism is needed to change the operating state of the wrench. For example, after tunneling the workpiece in the first direction, the wrench is simply rotated in the opposite direction to move the plate to the second state for ratcheting.

The plate is mounted to the second jaw by engagement of a pin in a slot, the slot having sections oriented to define the multiple directions of movement of the plate in the second state. In one embodiment, a first section of the slot is oriented to define an arcuate direction of motion about the workpiece, and a second section of the slot is oriented to define a spiral direction of motion away from the workpiece. In another embodiment, a first section of the slot is oriented to define a first spiral direction of motion away from the workpiece, and a second section of the slot is oriented to define a second, greater spiral direction of motion away from the workpiece.

The pin and the slot are disposed at a distal region of the plate and the second jaw. The slot is disposed in the plate and the pin is secured to the second jaw.

The plate is further mounted to the second jaw by engagement of a second pin in a second slot. In the first embodiment described above, a first section of the second slot is oriented to define an arcuate direction of motion about the workpiece, and a second section of the second slot is oriented to define a spiral direction of motion away from the workpiece. In this embodiment, the first sections of the first and second slots are arranged along a common arc of curvature having a center at the center of the workpiece. In the second embodiment discussed above, a portion of the second slot is oriented to define the first spiral direction of motion away from the workpiece.

The second pin and the second slot are disposed at a proximal region of the plate and the second jaw. The second slot is disposed in the plate and the second pin is secured to the second jaw.

In the first embodiment, the slots are elbow shaped. In the second embodiment, the first slot is elbow shaped and the second slot is straight.

The wrench also includes a spring positioned to bias the plate toward the opening. The plate and the spring are arranged so that turning the wrench over with respect to the workpiece reverses operation of the wrench when the plate is in the first and second states. That is, with the wrench turned over the wrench tightens or loosens the workpiece when rotated in the second direction, and produces the ratcheting action when rotated in the first direction.

The first jaw and the plate each have a plurality of workpiece engaging surfaces. At least some of the workpiece engaging surfaces are elongated sufficiently to engage a face of the workpiece over a major portion of a length of the face. The wrench also includes, in one embodiment, a projection that extends into the opening an defines an additional workpiece engaging surface that is short relative to other ones of the workpiece engaging surfaces on the plate.

At least some of the workpiece engaging surfaces are flat. In an embodiment, at least one of the workpiece engaging surfaces is beveled to define a recess for receiving a corner of the workpiece during rotation of the handle in the second direction.

Other features and advantages of the invention will become apparent from the following detailed description, and from the claims.

DETAILED DESCRIPTION

The wrenches described herein employ concepts similar to those of my U.S. Pat. Nos. 5,456,143, 5,829,327, and 6,223,630, all of which are entitled "OPEN-END RATCHET WRENCH" and are incorporated herein by reference. The wrenches of the present invention have many of the advantages of the wrenches of these patents, plus additional advantages that are discussed herein or that will become apparent.

Figure 2:
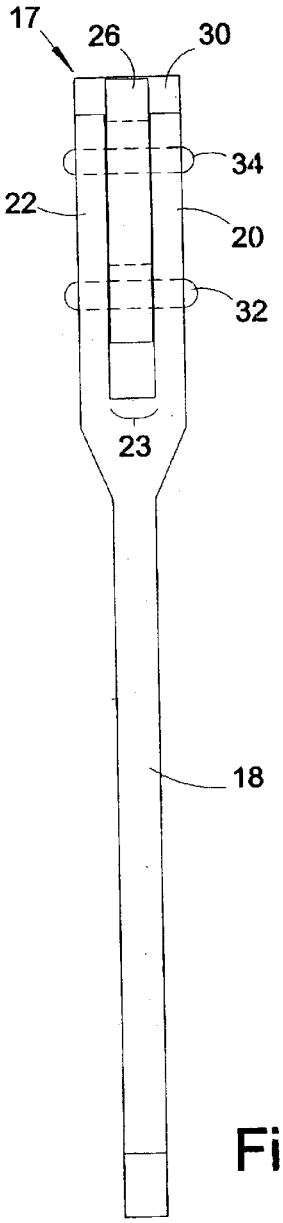
FIG. 2 is a left side view of the wrench of FIG. 1.
Figure 1:
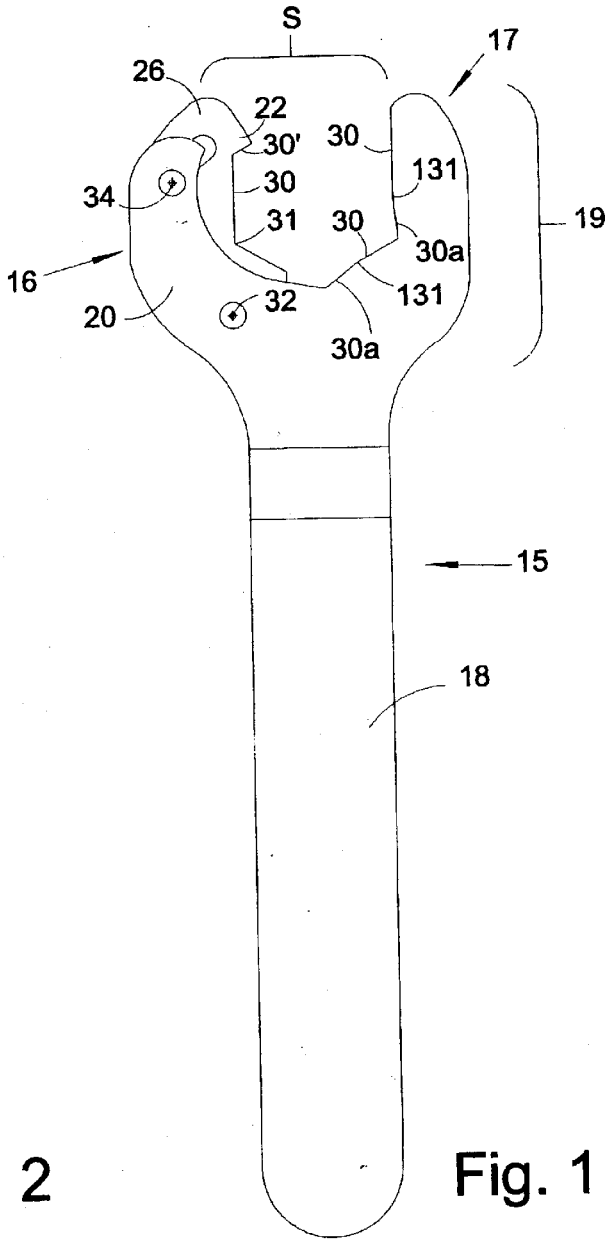
FIG. 1 is a top plan view of an open-end ratchet wrench.
Figure 3:
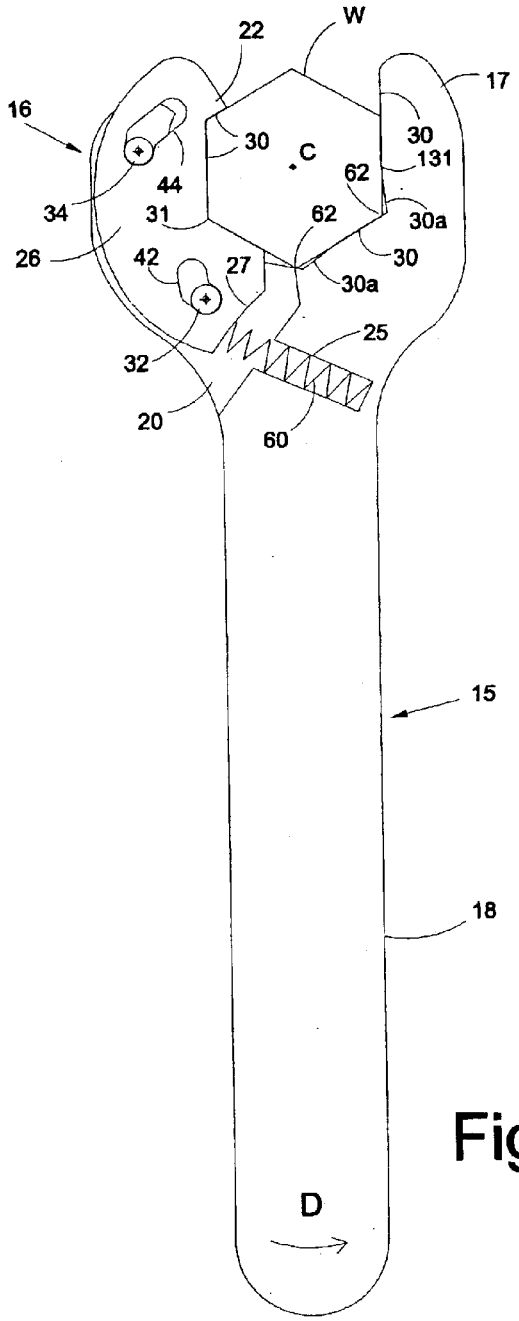
FIG. 3 shows the wrench of FIG. 1 with the front removed to illustrate a plate that is pivotally mounted on the wrench.

Referring to FIGS. 1–3, open-end ratchet wrench 15 includes a pair of stationary jaws 16, 17 at the end of an elongated handle 18. Jaw 16 supports a movable plate 26 (described in detail below) that defines a plurality of workpiece engaging surfaces 30. Additional workpiece engaging surfaces 30 are formed directly on jaw 17 and thus are stationary, unlike surfaces 30 on plate 26, which move with the plate. Jaw 16 is somewhat larger and more curved than jaw 17, and jaw 16 protrudes more markedly from handle 18 than does jaw 17 to accommodate plate 26. A space 23 is sandwiched between face plates 20, 22 of jaw 16 to provide space in jaw 16 for plate 26, which is arcuately shaped and elongated, and is movably mounted to face plates 20, 22 within jaw 16 in a manner described below. Face plates 20 and 22 are contiguous with handle 18. The components of wrench 15 are made of tool steel or hardened steel for ruggedness.

One of the advantages of wrench 15 is its simple construction. As discussed below, wrench 15 has only one moving part—plate 26 (and a spring 60 that engages plate 26 for purposes to be described). Wrench 15 is easy to manufacture, and can easily be scaled up or down in size (i.e., enlarged or miniaturized with respect to standard and metric-sized open-end wrenches).

As best shown in FIGS. 1 and 2, face plates 20 and 22 extend longitudinally to form jaw 16. Jaws 16, 17 form the head 19 of wrench 15 and are laterally spaced from each other by any suitable amount to define a central opening for receiving a workpiece (e.g., the head of a bolt, nut, or an in-line fitting). A sufficient spacing S is provided between jaws 16 and 17 to allow the workpiece to rotate, relative to wrench head 19, during ratcheting (as will be described) while still confined between jaws 16 and 17. As a result, wrench 15 does not have to be withdrawn from workpiece W (FIG. 3) to allow rotation around the center C of wrench head 19 during ratcheting action.

Plate 26 and jaw 17 provide at least four workpiece engaging surfaces 30 arranged over an arc of 240 degrees. As a result, the arrangement of surfaces 30 corresponds to a so called "6-point design". (That is, if plate 26 and jaw 17 were to be extended to define a 360 degree figure they would provide six cusps 31 or "points", and six surfaces 30. The term "6-point" design is commonly used for socket wrenches to describe the number of "points" defined by the socket.) Surfaces 30 are each sufficiently long to engage the face of workpiece W along the entire length of the face. Surfaces 30 define an angle of 120 degrees and a notch 31 therebetween.

Arcuate plate 26 is curved (more specifically, reniform, or kidney, shaped) and is slightly thinner than space 23 so that it may move easily between face plates 20 and 22. Thus, plate 26 is nearly as thick as stationary jaw 17, thereby enhancing the ruggedness of wrench 15. The curved shape of jaw 16 accommodates plate 26 between face plates 20, 22. Arcuate plate 26 includes a cusp-shaped projection 22 near its distal end that provides a fifth surface 30' of engagement with workpiece W. Surface 30' is oriented in the same way as surfaces 30, but is shorter than surfaces 30 so as not to protrude excessively into space S. In this configuration, wrench 15 corresponds more specifically to that of a "crow-foot" design. A "crow-foot" design is particularly useful for in-line and hydraulic fittings where it is important to capture as many workpiece surfaces as possible, especially in fittings made of softer material such as brass or aluminum. A particular advantage of wrench 15 designed herein is that even with the "crow-foot" design, the movability of plate 26 and relatively small size of projection 22 allow the workpiece W to be engaged by sliding wrench 15 directly onto workpiece W from the side.

The inner concave sides of arcuate plate 26 and jaw 17 (i.e., the sides of plate 26 and jaw 17 that oppose each other) are notched to define surfaces 30, which are flat. Plate 26 and jaw 17 include notches 31 defined by adjacent surfaces 30. Elongated surfaces 30 that meet at notch 31 are oriented at an angle that matches the angle defined by a pair of adjacent faces of the workpiece (which for a hexagonal bolt head or nut, is 120 degrees), except as described below.

Pins 32, 34 are secured in face plates 20, 22 and pass through corresponding slots 42, 44 in plate 26. Pin 32 is located at the proximal end of jaw 16, while pin 34 is located at the distal end of jaw 16. Proximal pin 32 passes through a proximal slot 42 of plate 26; distal pin 34 passes through a distal slot 44 of plate 26. The configurations of slots 42, 44 are discussed in detail below.

A spring 60 (FIG. 3) is positioned in the base of wrench head 19 at the distal end of handle 18. One end of spring 60 is captured within an angled (with respect to the central longitudinal axis of handle 18) hole 25. The opposite end of spring 60 engages the proximal surface 27 of plate 26, thereby biasing plate 26 distally and inwardly towards the center C of wrench head 19 and against workpiece W (FIG. 3). When wrench 15 is in the position shown in FIG. 3, pin 34 engages the proximal end of slot 44, and pin 32 engages the inner proximal surface of slot 42 at its rightmost end (as seen in FIG. 3). Elongated plate 26 thus is in a "locked" state and is immobile relative to jaw 17 (and the workpiece engaging surfaces 30 thereof) when wrench 15 is turned in a first, driving direction D (e.g., counterclockwise as shown in FIG. 3).

Figure 4:
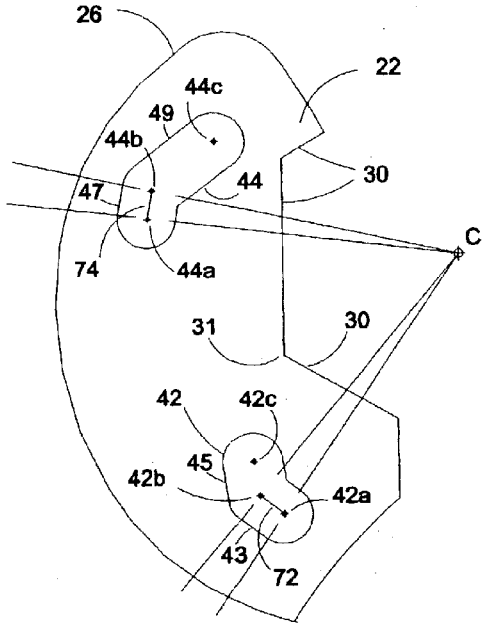
FIG. 4 shows an enlarged view of the plate of FIG. 3.

FIG. 4 shows arcuate plate 26 separately from the remainder of wrench 15. Details of proximal slot 42 and distal slot 44 are seen. Each slot 42, 44 is elbow shaped and includes a relatively short section (43, 47, respectively) and relatively long section (45, 49, respectively) oriented obliquely (140°) to the shorter section. Point 42*a* in section 43 of proximal slot 42 designates the resting position of pin 32 when plate 26 is in the locked state shown in FIG. 3. Similarly, point 44*a* represents resting position of pin 34 at the proximal end of section 47 of slot 44 when plate 26 is in the locked state. Point 42*b* lies at the intersection of sections 43, 45 of slot 42, and represents the location of pin 32 when in the mid-position of slot 42. Point 44*b* is disposed at the intersection of sections 47, 49 of slot 44, and represents the location of pin 34 in the mid-position of distal slot 44. (As described below, movement of pins 32, 34 to positions 42*b*, 44*b*, respectively, is the first step in moving plate 26 to the unlocked state to allow ratcheting when wrench 15 is turned in the opposite direction from driving direction D.)

Arc 72 represents the path of travel of pin 32 as it travels from the locked state 42*a* to the unlocked mid-position 42*b* through proximal slot section 47. Similarly, arc 74 represents the path of travel of pin 34 as it passes from locked position 44*a* to the unlocked mid-position 44*b* through distal slot section 47. It should be noted that arcs 72, 74 are centered around center point C. By virtue of this rotation around center point C, it should be noted that plate 26 does not rotate outwardly or away from jaw 17 during the initiation of the unlocking maneuver; instead, plate 26 simply rotates around center point C.

Point 42*c* at the distal end of slot section 45 represents the final position of pin 32 when plate 26 has moved fully open (with respect to jaw 17) during the ratcheting operation (described below). Similarly, point 44*c* represents the final resting position of pin 34 in the distal end of slot section 49 when plate 26 has moved fully open during ratcheting. The arcs defined by slot sections 45, 49 are differently oriented and are centered around different points within space S (the centering of such arcs within space S is described in my U.S. Pat. No. 5,456,143). The movement of pins 32, 34 from intermediate positions 42*b*, 44*c* to the respective ends 42*c*, 44*c* of slots 42, 44 causes plate 26 to spiral proximally and outwardly away from center point C. This opens engaging surfaces 30 of plate 26 sufficiently with respect to stationary engaging surfaces 30 of jaw 17 to enable the engaging surfaces to slide over the workpiece faces, thereby allowing the workpiece to remain stationary.

Thus, when wrench 15 is turned opposite to direction D (FIG. 3), plate 26 moves from the first (locked) state to the second (unlocked) state, and undergoes movement in multiple directions with respect to stationary jaw 17. Specifically, plate 26 first rotates around center point C (i.e. to position pins 32, 34 at respective slot midpoints 42*b*, 44*b*), and then spirals outwardly and proximally away from center point C (as pins 32, 34 move to respective positions 42*c*, 44*c* in slots 42, 44) and jaw 17. The locations of points 42*c*, 44*c*—and hence the orientation of slot sections 45, 49 with respect to slot sections 43, 47, respectively, and the length of slot sections 45, 47 are determined by locating the position of plate 26 which is sufficiently shifted outwardly from jaw 17 so that wrench 15 can rotate around workpiece W during the ratcheting maneuver, and yet still have sufficient clearance so that corners of workpiece W do not bind against surfaces 30 of jaw 17 and arcuate plate 26. As arcuate plate 26 spirals to the fully open position, pin 32 moves in slot section 45 from point 42*b* to 42*c*, and pin 34 moves from point 44*b* to point 44*c* in slot section 49. This fully open position allows for rotation of workpiece W within head 19 of wrench 15.

Figure 7:
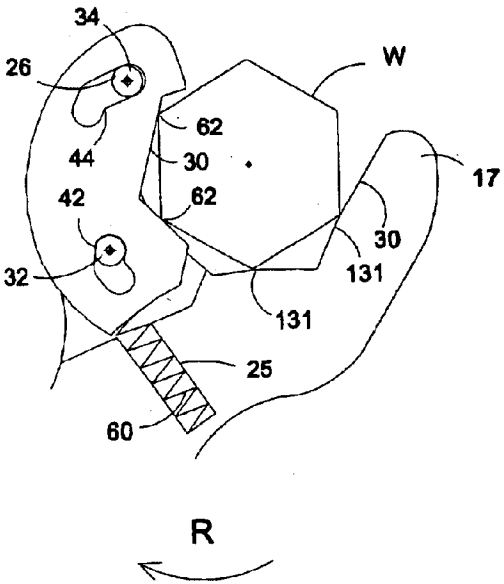
FIGS. 6 and 7 show the operation of the wrench of FIG. 1 in a non-driving (ratcheting) direction (R).
Figure 6:
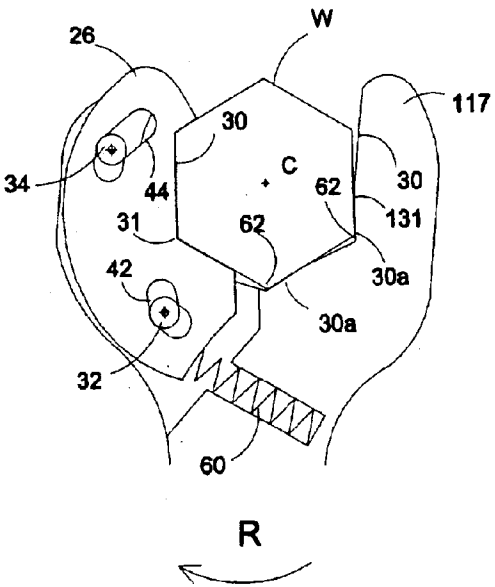
Figure 5:
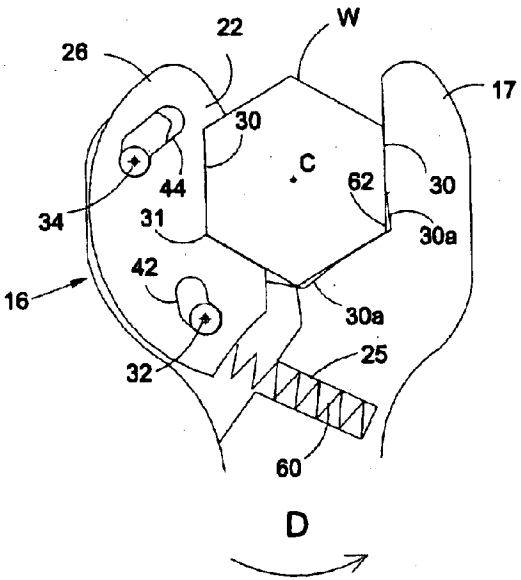
FIG. 5 illustrates the wrench of FIG. 1 being used to turn a workpiece in the driving direction (D).

The driving and ratcheting operations of wrench 15 are illustrated in FIGS. 5–7. Initially, it will be appreciated that when the wrench is slid onto workpiece W, the workpiece engages the outer surface of projection 22, thereby moving plate 26 outwardly about pin 32 to make room for workpiece W to enter space S. Spring 60 then returns plate 26 to the locked state. Wrench 15 is rotated in driving direction D (counterclockwise in FIG. 5) to turn workpiece W. As handle 18 is turned in the driving direction, pressure develops between the workpiece W and surfaces 30, 30' of plate 26 and jaw 17. This pressure urges plate 26 outwardly and away from center C, but such motions are prevented by the engagement of pin 34 against the proximal end of slot 44 and the engagement of pin 32 against the proximal and rightmost end surface of slot 42. Accordingly, with plate 26 in the "locked" state shown in FIG. 5, plate 26 remains immobile with respect to jaw 16 (and jaw 17). Plate 26 and jaw 17 thus grasp workpiece W between them at elongated surfaces 30, 30' and rotate workpiece W in driving direction D.

When handle 18 is turned in the opposite (e.g., clockwise) direction R (FIGS. 6 and 7), ratcheting occurs. That is, surfaces 30 of plate 26 and jaw 17 slide over the surfaces of the workpiece, allowing the workpiece to remain stationary. When handle 18 is first rotated in the ratcheting direction, pins 32 and 34 travel through sections 43, 47 of respective slots 42, 44 along common arcs of curvature 72, 74 respectively, as shown in FIG. 4, to move plate 26 from the locked state (FIG. 5) to the unlocked state (FIG. 6). That is, pin 32 moves to the midpoint 42*b* of slot 42, and pin 34 moves to the midpoint 44*b* of slot 44. As the result, arcuate plate 26 rotates around center C with handle 18 until pins 32, 34 reach the midpoints of slots 42 and 44 respectively. This operation requires approximately 10–12 degrees of handle rotation, which corresponds to the arc lengths 72 and 74 of slot sections 43, 47 (with respect to center C).

Surfaces 30 of jaw 17 are beveled at their proximal ends to define a pair of proximal recesses 30*a*. The portions of surfaces 30 in recesses 30*a* are angled about 10 degrees with respect to the remaining portions of surfaces 30, starting at a points 131 that correspond to the midpoint of corresponding surfaces 60 of workpiece W. Plate 26 rotates around center C during the initial unlocking movement of handle 18, and does not move away from jaw 17. Corners 62 of workpiece W can move into recesses 30*a* on jaw 17, thereby avoiding binding in the wrench.

With pins 32, 34 positioned as just described (and shown in FIG. 6), plate 26 is "unlocked" and is ready for ratcheting.

As handle 18 is rotated further counterclockwise (FIG. 7), the engagement of plate 26 against workpiece W causes plate 26 to spiral outwardly and proximally from center C as each corner of the workpiece slides across an elongated surface 30 of plate 26. The spiraling motion of plate 26 is constrained and controlled by the movement of pins 32, 34 in respective slot sections 45, 49. That is pin 32 moves into position 42*c* in the distal end of slot 42, and pin 34 moves to position 44*c* in the distal end of slot 44.

In the 6-point design shown in FIGS. 1–7 approximately 60 degrees of handle rotation are required to ratchet jaws 16, 17 around one corner of the hexagonal workpiece. As each corner of workpiece W passes across a flat surface 30 into an adjacent notch 31, the biasing of plate 26 by spring 60 causes plate 26 to return to the position shown in FIG. 6.

Because of the symmetrical construction of wrench 15, the driving and ratcheting directions can be reversed simply by turning wrench 15 over with respect to the workpiece. (i.e., so that jaw 17 is on the left when viewed from above). In this orientation, the driving direction D is clockwise, and the ratcheting direction R is counterclockwise.

Other embodiments are within the scope of the claims.

Figure 10:
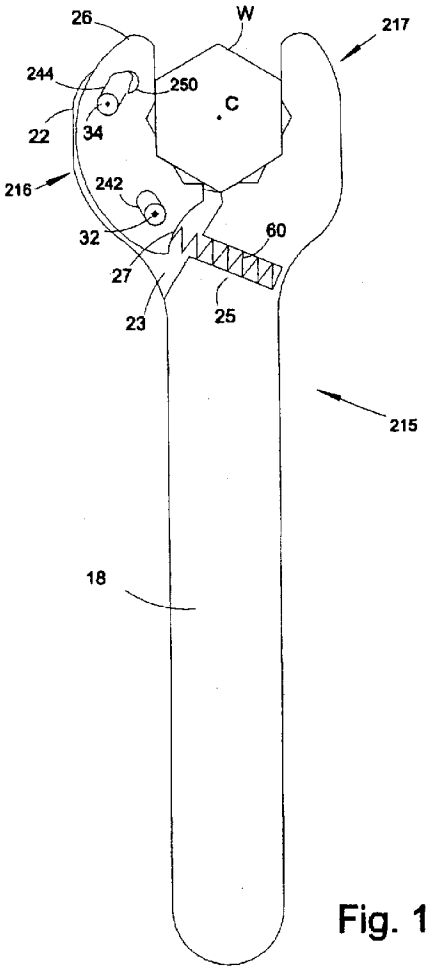
FIG. 10 shows the wrench of FIG. 8 with the front removed to illustrate a plate that is pivotally mounted on the wrench.
Figure 8:
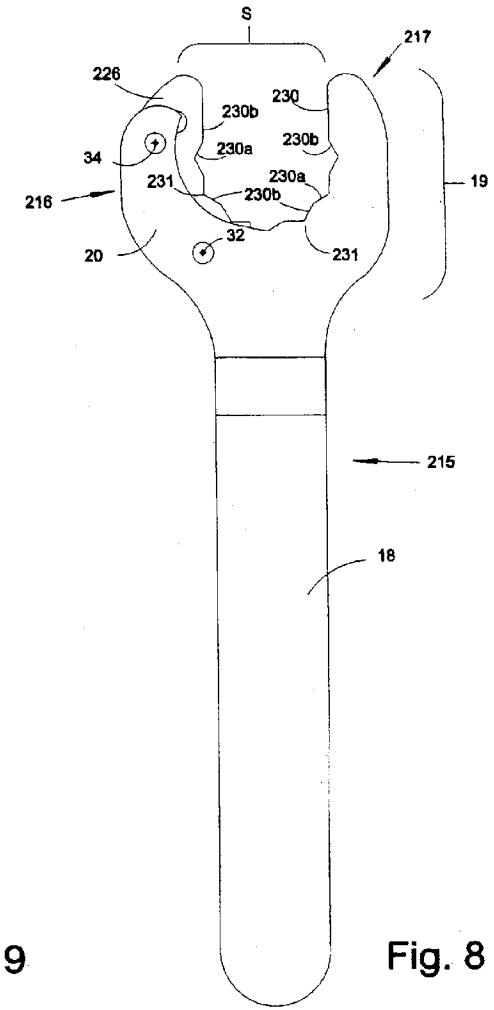
FIG. 8 shows a top plan view of another embodiment of an open-end ratchet wrench.
Figure 9:
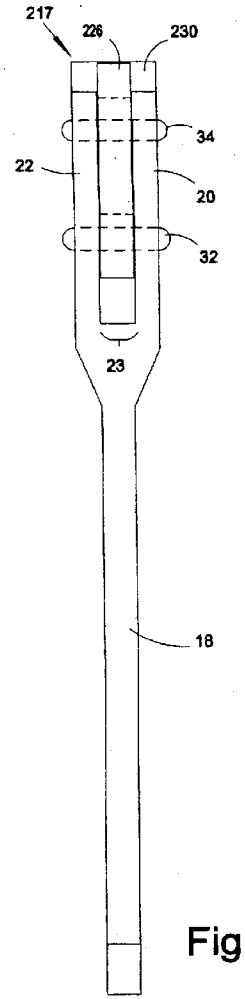
FIG. 9 is a side view of the wrench of FIG. 8.

For example, referring to FIGS. 8–10 movable plate 226 and stationary jaw 217 provide a total of sixteen surfaces 230*a*, 230*b* and eight cusps 230 arranged over an arc of 240 degrees. As a result, the arrangement of surfaces 230*a* and 230*b* on plate 226 and jaw 217 correspond to a so-called "12-point" design. (That is if the plate 226 and jaw 217 were to be extended to define a 360 degree figure, they would provide twelve cusps 230 or "points", and twenty-four surfaces 230*a*, 230*b*. The term "12-point" design is commonly used for socket wrenches to describe the number of "points" defined by the socket).

When elongated plate 226 is in the locked state (shown in FIGS. 12 and 13), elongated surfaces 230*a*, 230*b* extend into central opening S by an amount sufficient to engage and grasp the faces of a hexagonal workpiece when holding a hexagonal workpiece in the position shown in FIG. 10 or in a position rotated by 30 degrees from that. Each elongated surface 230*a*, 230*b* is configured to engage a face of the workpiece over a major portion the length of the face. Elongated plated 226 is restrained in its movement and held between face plates 20, 22 by two pins 32 and 34 which pass from face plate 20 to face plate 22, and respective slots 242 and 244 in elongated plate 226. Slot 244 is located in a distal region of plate 226, slot 242 is positioned in the proximal base of plate 226.

As seen in FIG. 10, slot 242 is generally straight while slot 244 has an elbowed shape (the angle between the sections of slot 244 is 130°). Recall that the configuration and orientation of slots 42, 44 in plate 26 (FIG. 4), cause plate 26 to undergo two different motions during ratcheting—first, rotation about center point C, followed by spiraling proximally and outwardly from center point C. In contrast, the configuration and orientation of slots 242 and 244 are such that movement of the elongated plate 226 is directed in a continuous spiral motion downwardly and away from center C and workpiece W to open plate 216 and allow the engaging surfaces 230 to slide over the workpiece. But, in contrast as to plate 216 although the kind of motion during ratcheting is the same (spiraling), as will be described, plate 216 undergoes a relatively small spiral direction of motion away from jaw 17 when ratcheting is initiated, followed by a greater spiral direction of motion as ratcheting progresses. A spring 60 held in hole 25 biases against proximal base 27 of elongated plate 226. Pressure from this spring directs plate 226 distally and inwardly towards center C and workpiece W.

Figure 13:
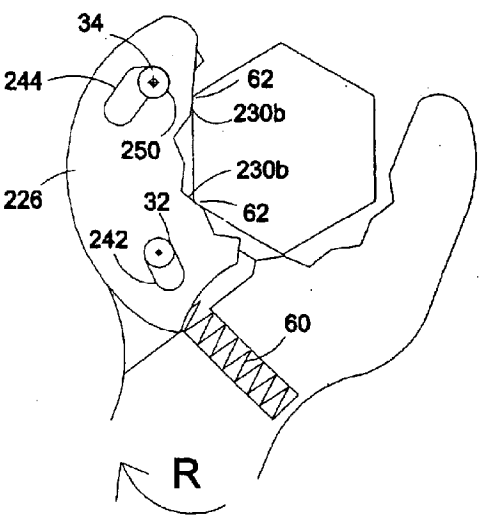
FIGS. 12 and 13 show the operation of the wrench of FIG. 8 in the non-driving (ratcheting) direction (R).
Figure 12:
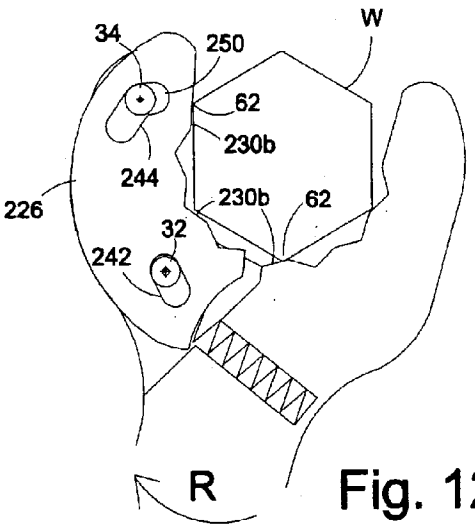
Figure 11:
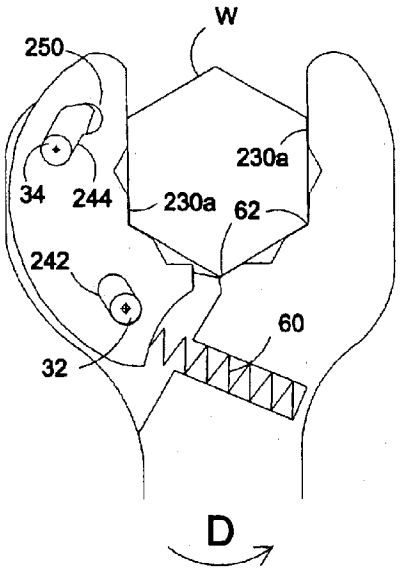
FIG. 11 illustrates the wrench of FIG. 8 being used to turn a workpiece in the driving direction (D).

Referring to FIGS. 11–13, in operation after jaws 216, 217 are slid onto workpiece W from the side, wrench 215 is rotated in driving direction D to turn workpiece W. As handle 18 is turned in the driving direction, pressure develops between workpiece W and surfaces 230*a* of plate 226 and jaw 217. This pressure urges plate 226 outwardly and distally away from center C. This motion is prevented by the engagement of pin 32 against a proximal surface of slot 242, and the engagement of pin 34 against the proximal end of slot 244. Accordingly, plate 226 remains immobile (i.e., locked) with respect to jaws 216, 217. Plate 226 and jaw 217 grasp workpiece W between them at elongated surfaces 230*a* and rotate workpiece W in the driving direction D (counterclockwise).

When handle 18 is turned in the opposite (example, clockwise) direction from arrow D, ratcheting occurs. That is, surfaces 230 of plate 226 and jaw 217 slide over the surfaces of the workpiece, allowing the workpiece to remain stationary. This operation is explained in detail below and is shown in FIGS. 12 and 13.

When handle 18 is first rotated in the ratcheting direction, pins 32, 34 travel from their locked positions. Specifically, pin 32 moves toward the distal end of slot 242 (but does not yet reach the distal end), and pin 34 moves to the midpoint of slot 244 between the obliquely-oriented sections of slot 244, thereby moving plate 226 to the unlocked state. This operation requires approximately 10–12 degrees of handle rotation, which corresponds to the arc length of slot 242 and the arc length of the proximal segment of slot 244 (defined by the portion of slot 242 between the positions of pin 32 in FIGS. 11 and 12).

It should be noted that the arcs described above are not centered around center C, but instead are centered about a common point within space S (as described in my U.S. Pat. No. 5,456,143) to define a relatively shallow spiral direction of movement of plate 216 outwardly and away from jaw 217. Because of the slight outward spiraling motion of plate 226, and because of the multiple cusps 231 found in jaw 217, there is no tendency for workpiece W to "bind" during the initial unlocking maneuver. Therefore, recesses such as recesses 30*a* discussed above and shown in FIGS. 1–7 are not needed.

As handle 18 is rotated further clockwise (FIG. 13), engagement of plate surfaces 230*b* of plate 226 against workpiece W cause plate 226 to spiral outwardly from center C to an even larger degree than occurs when plate 216 moves from the locked to the unlocked position. The spiraling motion of plate 226 around pin 32 (which now moves to the distal end of slot 242) is constrained by the distal segment 250 of slot 244 (which also defines an arc centered within space S as described in my U.S. Pat. No. 5,456,143). That is, pin 34 travels within section 250 as plate 226 spirals outwardly during ratcheting.

Spring 60 biases plate 226 distally and inwardly towards center C. Thus, as the corners of the workpiece move towards notches 231, spring 60 urges plate 226 to pivot back into full engagement with the workpiece surfaces. In the 12-point design shown in FIGS. 11–13, approximately 30 degrees of handle rotation are needed to ratchet jaws 216, 217 around one corner of a hexagonal workpiece.

Because of the symmetrical construction of wrench 215, the driving and ratcheting directions can be reversed simply by turning wrench 215 over with respect to the workpiece (i.e., so that jaw 217 is on the left when viewed from above). In this orientation, the driving direction D is clockwise and the ratcheting direction R is counterclockwise.

Still other embodiments are within the scope of the following claims.

For example the wrench may have an elongated plate with more or fewer workpiece grasping surfaces.

The slots and pins may be reversed so that both pins are embedded (located) within plate 26 or 226 and the slots are located at the proximal and distal ends of jaw 16 or 216.

Additionally, arcuate plate 26 or 226 may contain a combination of a pin at one end and a slot at the other and correspondingly jaw 16 or 216 would have a slot at one end and a pin at the other.

The wrench handle need not be in line with, or in the same plane as, the jaws, as is shown in the figures. Instead, as is typical with open-end wrenches, the handle may be offset at an acute angle to the jaws either in the plane of the jaws, or out of the plane of the jaws, or both. Furthermore, a wrist pin may connect handle 18 with head 19 and allow pivoting of the handle upwards or downwards with respect to the plane of head 19. Also, the handle may be curved such as is commonly found in an "obstruction" type of wrench.

Instead of a coil spring, a flat spring may be used and indeed, the spring may be fixed to the handle in other ways.

What is claimed is:

1. A wrench comprising a pair of jaws disposed on a handle, the jaws being spaced to define an opening for a workpiece, a first one of the jaws defining a stationary workpiece engaging surface adjacent the opening, and a plate defining a second workpiece engaging surface adjacent the opening, the plate being movably mounted to a second one of the jaws to allow selective movement of the plate relative to the stationary workpiece engaging surface between:

a) a first state in which the plate is immobile with respect to the first jaw so that rotation of the handle in a first direction causes the plate and the first jaw to grasp the workpiece between the respective engaging surfaces and turn the workpiece in a first direction, and b) a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary, the plate being mounted for the selective movement between the first state and the second state in response to rotation of the handle.

2. The wrench of claim 1 wherein the plate is mounted to the second jaw by engagement of a pin in a slot, the slot having sections oriented to define the multiple directions of movement of the plate in the second state.

3. The wrench of claim 2 wherein a first one of the sections of the slot is oriented to define an arcuate direction of motion about the workpiece, and a second one of the sections of the slot is oriented to define a spiral direction of motion away from the workpiece.

4. The wrench of claim 2 wherein a first one of the sections of the slot is oriented to define a first spiral direction of motion away from the workpiece, and a second one of the sections of the slot is oriented to define a second, greater spiral direction of motion away from the workpiece.

5. The wrench of claim 2 wherein the pin and the slot are disposed at a distal region of the plate and the second jaw.

6. The wrench of claim 2 wherein the slot is disposed in the plate and the pin is secured to the second jaw.

7. The wrench of claim 2 wherein the plate is further mounted to the second jaw by engagement of a second pin in a second slot.

8. A wrench comprising a pair of jaws disposed on a handle, the jaws being spaced to define an opening for a workpiece, a first one of the jaws defining a stationary workpiece engaging surface adjacent the opening, and a plate defining a second workpiece engaging surface adjacent the opening, the plate being movably mounted to a second one of the jaws to allow selective movement of the plate relative to the stationary workpiece engaging surface between:

a) a first state in which the plate is immobile with respect to the first jaw so that rotation of the handle in a first direction causes the plate and the first jaw to grasp the workpiece between the respective engaging surfaces and turn the workpiece in a first direction, and b) a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary, wherein the plate is mounted to the second jaw by engagement of a pin in a slot, the slot having sections oriented to define the multiple directions of movement of the plate in the second state, the plate is further mounted to the second jaw by engagement of a second pin in a second slot, and the second slot has a first section oriented to define an arcuate direction of motion about the workpiece, and a second section oriented to define a spiral direction of motion away from the workpiece.

9. A wrench comprising a pair of jaws disposed on a handle, the jaws being spaced to define an opening for a workpiece, a first one of the jaws defining a stationary workpiece engaging surface adjacent the opening, and a plate defining a second workpiece engaging surface adjacent the opening, the plate being movably mounted to a second one of the jaws to allow selective movement of the plate relative to the stationary workpiece engaging surface between:

a) a first state in which the plate is immobile with respect to the first jaw so that rotation of the handle in a first direction causes the plate and the first jaw to grasp the workpiece between the respective engaging surfaces and turn the workpiece in a first direction, and b) a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary, wherein the plate is mounted to the second jaw by engagement of a pin in a slot, the slot having sections oriented to define the multiple directions of movement of the plate in the second state, the plate is further mounted to the second jaw by engagement of a second pin in a second slot, and a portion of the second slot is oriented to define a spiral direction of motion away from the workpiece.

10. The wrench of claim 7 wherein the second pin and the second slot are disposed at a proximal region of the plate and the second jaw.

11. The wrench of claim 7 wherein the second slot is disposed in the plate and the second pin is secured to the second jaw.

12. The wrench of claim 1 wherein the plate is mounted to the second jaw by engagement of a first pin in a first slot at a distal region of the plate and the second jaw, and engagement of a second pin in a second slot at a proximal region of the plate and the second jaw, the first slot having sections oriented to define the multiple directions of movement of the plate in the second state.

13. The wrench of claim 12 wherein a first one of the sections of the first slot is oriented to define an arcuate direction of motion about the workpiece, and a second one of the sections of the first slot is oriented to define a spiral direction of motion away from the workpiece.

14. The wrench of claim 13 wherein the first section of the first slot and a portion of the second slot are arranged along a common arc of curvature having a center disposed at the center of the workpiece.

15. A wrench comprising a pair of jaws disposed on a handle, the jaws being spaced to define an opening for a workpiece, a first one of the jaws defining a stationary workpiece engaging surface adjacent the opening, and a plate defining a second workpiece engaging surface adjacent the opening, the plate being movably mounted to a second one of the jaws to allow selective movement of the plate relative to the stationary workpiece engaging surface between:

a) a first state in which the plate is immobile with respect to the first jaw so that rotation of the handle in a first direction causes the plate and the first jaw to grasp the workpiece between the respective engaging surfaces and turn the workpiece in a first direction, and b) a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary, wherein the plate is mounted to the second jaw by engagement of a first pin in a first slot at a distal region of the plate and the second jaw, and engagement of a second pin in a second slot at a proximal region of the plate and the second jaw, the first slot having sections oriented to define the multiple directions of movement of the plate in the second state, wherein a first one of the sections of the first slot is oriented to define an arcuate direction of motion about the workpiece, and a second one of the sections of the first slot is oriented to define a spiral direction of motion away from the workpiece, and wherein the slots are elbow shaped.

16. The wrench of claim 12 wherein a first one of the sections of the first slot and a portion of the second slot are oriented to define a first spiral direction of motion away from the workpiece, and a second section of the first slot is oriented to define a second, greater spiral direction of motion away from the workpiece.

17. The wrench of claim 16 wherein the first slot is elbow shaped and the second slot is straight.

18. The wrench of claim 12 wherein the slots are disposed in the plate and the pins are secured to the second jaw.

19. The wrench of claim 1 further comprising a spring positioned to bias the plate toward the opening.

20. A wrench comprising a pair of jaws disposed on a handle, the jaws being spaced to define an opening for a workpiece, a first one of the jaws defining a stationary workpiece engaging surface adjacent the opening, and a plate defining a second workpiece engaging surface adjacent the opening, the plate being movably mounted to a second one of the jaws to allow selective movement of the plate relative to the stationary workpiece engaging surface between:

a) a first state in which the plate is immobile with respect to the first jaw so that rotation of the handle in a first direction causes the plate and the first jaw to grasp the workpiece between the respective engaging surfaces and turn the workpiece in a first direction, and b) a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary, further comprising a spring positioned to bias the plate toward the opening, and wherein the plate and the spring are arranged so that turning the wrench over with respect to the workpiece reverses operation of the wrench when the plate is in the first and second states.

21. The wrench of claim 1 wherein the first jaw and the plate each have a plurality of workpiece engaging surfaces.

22. The wrench of claim 21 wherein at least some of the workpiece engaging surfaces are elongated sufficiently to engage a face of the workpiece over a major portion of a length of the face.

23. A wrench comprising a pair of jaws disposed on a handle, the jaws being spaced to define an opening for a workpiece, a first one of the jaws defining a stationary workpiece engaging surface adjacent the opening, and a plate defining a second workpiece engaging surface adjacent the opening, the plate being movably mounted to a second one of the jaws to allow selective movement of the plate relative to the stationary workpiece engaging surface between:

a) a first state in which the plate is immobile with respect to the first jaw so that rotation of the handle in a first direction causes the plate and the first jaw to grasp the workpiece between the respective engaging surfaces and turn the workpiece in a first direction, and b) a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary, wherein the first jaw and the plate each have a plurality of workpiece engaging surfaces, and further comprising a projection that extends into the opening and defines an additional workpiece engaging surface that is short relative to other ones of the workpiece engaging surfaces on the plate.

24. The wrench of claim 21 wherein at least some of the workpiece engaging surfaces are flat.

25. The wrench of claim 21 wherein at least one of the workpiece engaging surfaces is beveled to define a recess for receiving a corner of the workpiece during rotation of the handle in the second direction.

26. A method for operating on a workpiece, comprising providing a wrench comprising a pair of jaws disposed on a handle, the jaws being spaced to define an opening for a workpiece, a first one of the jaws defining a stationary workpiece engaging surface adjacent the opening, and a plate defining a second workpiece engaging surface adjacent the opening, the plate being movably mounted to a second one of the jaws, engaging the wrench with the workpiece, disposing the plate in a first state in which the plate is immobile with respect to the first jaw so that rotation of the handle in a first direction causes the plate and the first jaw to grasp the workpiece between the respective engaging surfaces and turn the workpiece in a first direction, disposing the plate a second state in which the plate is movable with respect to the first jaw so that rotation of the handle in a second, opposite direction causes the plate to move in multiple directions with respect to the first jaw to enable the respective engaging surfaces to slide over the workpiece, thereby allowing the workpiece to remain stationary; and performing each disposing step by rotating the handle.

* * * * *